US007905368B1

(12) United States Patent
Christensen

(10) Patent No.: US 7,905,368 B1
(45) Date of Patent: Mar. 15, 2011

(54) PORTABLE WATER TANK WITH VALVED DRAIN SLEEVE

(75) Inventor: Jan Christensen, Rock Island, IL (US)

(73) Assignee: Eldred Corporation, Milan (IT)

( * ) Notice: Subject to any disclaimer, the term of this patent is extended or adjusted under 35 U.S.C. 154(b) by 282 days.

(21) Appl. No.: 12/073,836

(22) Filed: Mar. 11, 2008

(51) Int. Cl.
*B65D 30/10* (2006.01)
*B65D 33/02* (2006.01)
*B65D 90/02* (2006.01)
*A45C 13/04* (2006.01)

(52) U.S. Cl. ..... 220/9.2; 220/565

(58) Field of Classification Search ..... 220/9.1–9.4, 220/4.12, 4.16, 495.01, 495.06, 565, 573; 4/488, 507; 52/646; 251/9
See application file for complete search history.

(56) References Cited

U.S. PATENT DOCUMENTS 1,015,754 A * 1/1912 Blake ..... 251/9
1,664,887 A * 4/1928 Kirkham et al. ..... 52/169.7
1,738,017 A * 12/1929 Phillips ..... 4/488
2,567,514 A * 9/1951 Hoffman ..... 4/587
2,622,837 A * 12/1952 Goodman ..... 251/9
2,749,956 A * 6/1956 Eldred ..... 220/9.3
3,460,797 A * 8/1969 Allenbaugh, Jr. ..... 251/9
6,071,213 A * 6/2000 Raasch et al. ..... 482/29
7,188,747 B2 * 3/2007 Bennett et al. ..... 220/565
2004/0118844 A1 * 6/2004 Bennett et al. ..... 220/4.12
* cited by examiner

*Primary Examiner* — Anthony Stashick
*Assistant Examiner* — Harry A Grosso
(74) *Attorney, Agent, or Firm* — Shlesinger, Arkwright & Garvey LLP

(57) ABSTRACT

A portable water tank comprises a foldable receptacle having a bottom wall and vertical sidewalls; a frame to support the sidewalls in an upright position, the frame including upper and lower rails, and vertical posts joining the upper rail to the lower rail. The receptacle includes a drain sleeve disposed near the bottom wall and extends between corresponding portions of the upper and lower rails, and between a pair of the posts. The sleeve overlies the corresponding portion of the lower rail. Reinforcement members are attached to the corresponding portions of the lower rail and the pair of posts. A valve is operably attached to the pair of posts and the corresponding portion of the lower rail. The valve is operably associated with the drain sleeve and has an open position to allow water within the receptacle to flow through the drain sleeve, and a closed position to keep water from flowing through the drain sleeve.

25 Claims, 4 Drawing Sheets

PORTABLE WATER TANK WITH VALVED DRAIN SLEEVE

FIELD OF THE INVENTION

The present invention is directed generally to a portable water tank and specifically to a portable water tank having a valved drain sleeve.

SUMMARY OF THE INVENTION

The present invention provides a portable water tank, comprising a foldable receptacle having a bottom wall and vertical sidewalls; a frame to support the sidewalls in an upright position, the frame including upper and lower rails, and vertical posts joining the upper rail to the lower rail.

The receptacle includes a drain sleeve disposed near the bottom wall, the sleeve extending between corresponding portions of the upper and lower rails, and between a pair of the posts, the sleeve overlying the corresponding portion of the lower rail. Reinforcement members are attached to the corresponding portion of the lower rail and the pair of posts. A valve is operably attached to the pair of posts and the corresponding portion of the lower rail. The valve is operably associated with the drain sleeve, the valve having an open position to allow water within the receptacle to flow through the drain sleeve, and a closed position to keep water from flowing through the drain sleeve.

DETAILED DESCRIPTION OF THE INVENTION

Figure 1:
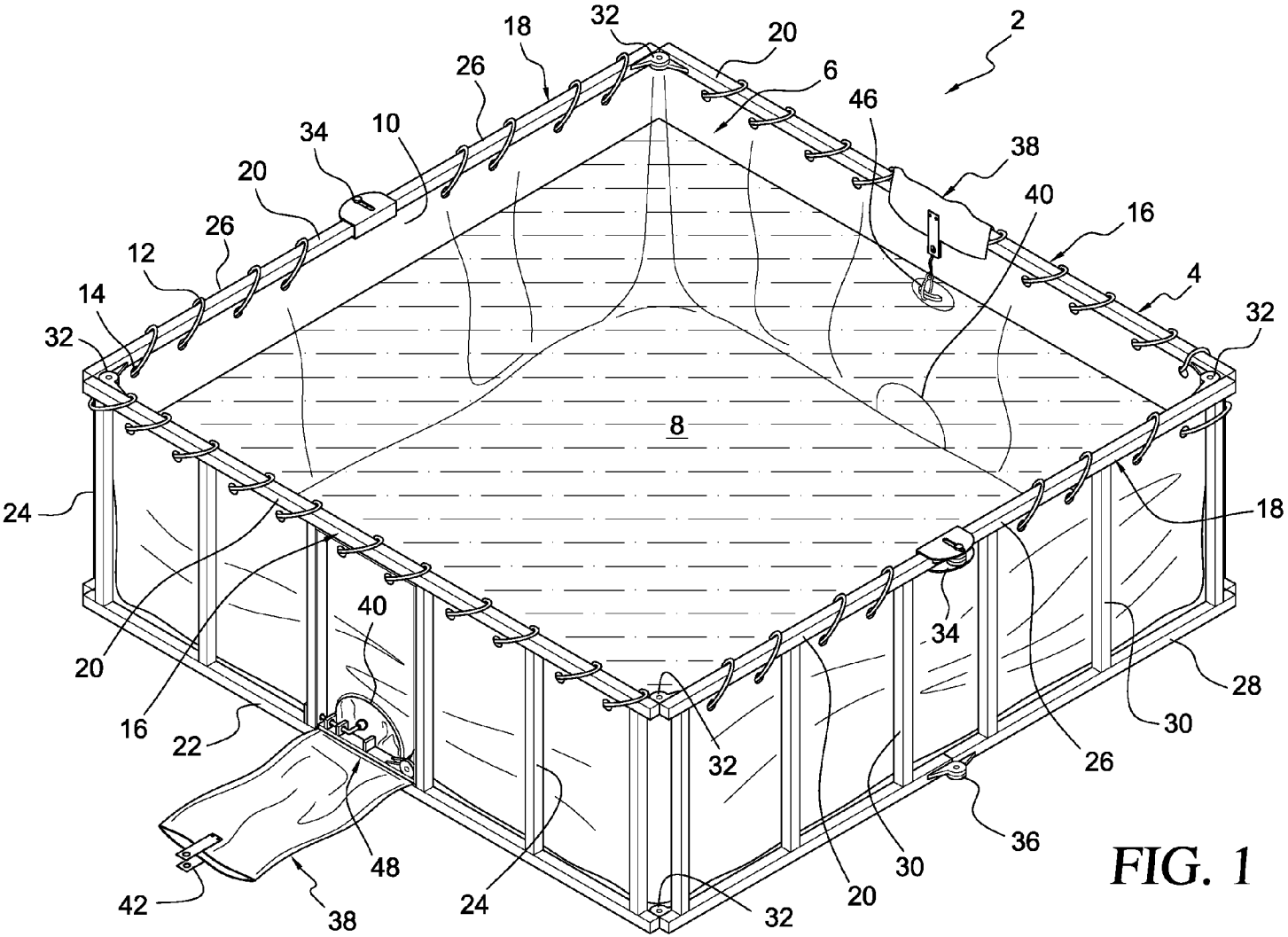
FIG. 1 is a perspective view of a portable water tank embodying the present invention.

A portable water tank 2 embodying the present invention is disclosed in FIG. 1. The tank 2 has a folding frame 4 and a flexible receptacle 6 made from conventional foldable watertight material. The receptacle 6 has a bottom wall 8 and vertical sidewalls 10 secured to the frame 4 with a rope 12 or similar material threaded through openings 14 along the upper edge portion of the receptacle 6 and spirally wound around the upper rails of the frame 4. The frame 4 forms a free-standing structure to provide support to the sidewalls 10 in the vertical position so as to keep the receptacle 6 in the open position ready to receive water. The tank 2 is shown filled with water to a level below the openings 14.

The frame 4 is shown 4-sided, but any number of sides may be used. The frame 4 has a pair of opposite sides 16 and another pair of opposite sides 18. Each side 16 includes an upper rail 20, a lower rail 22 and a plurality of vertical posts 24 joining the lower rails to the upper rails. Each of the sides 18 includes a pair of upper rails 26 and a pair of lower rails 28. A plurality of posts 30 join the lower rails 28 to the upper rails 26. The frame 4 is preferably made from tubular members of any cross-sectional shape, such as square, and light-weight material, such as aluminum, for portability.

The sides 16 are attached to the corresponding sides 18 with hinges 32 secured to the respective corners of the adjacent sides. Each of the sides 18 is made of two sections attached to each other with hinges 34 and 36. The hinges 32, 34 and 36 allow the frame 4 to be folded into a compact, substantially flat configuration, where the two sections of the sides 18 fold inwardly about the hinges 32, 34 and 36 so that they become parallel to each other and to the sides 16. A similar foldable tank is disclosed in co-pending application Ser. No. 11/716,664, filed on Mar. 12, 2007, incorporated herein by reference.

Figure 2:
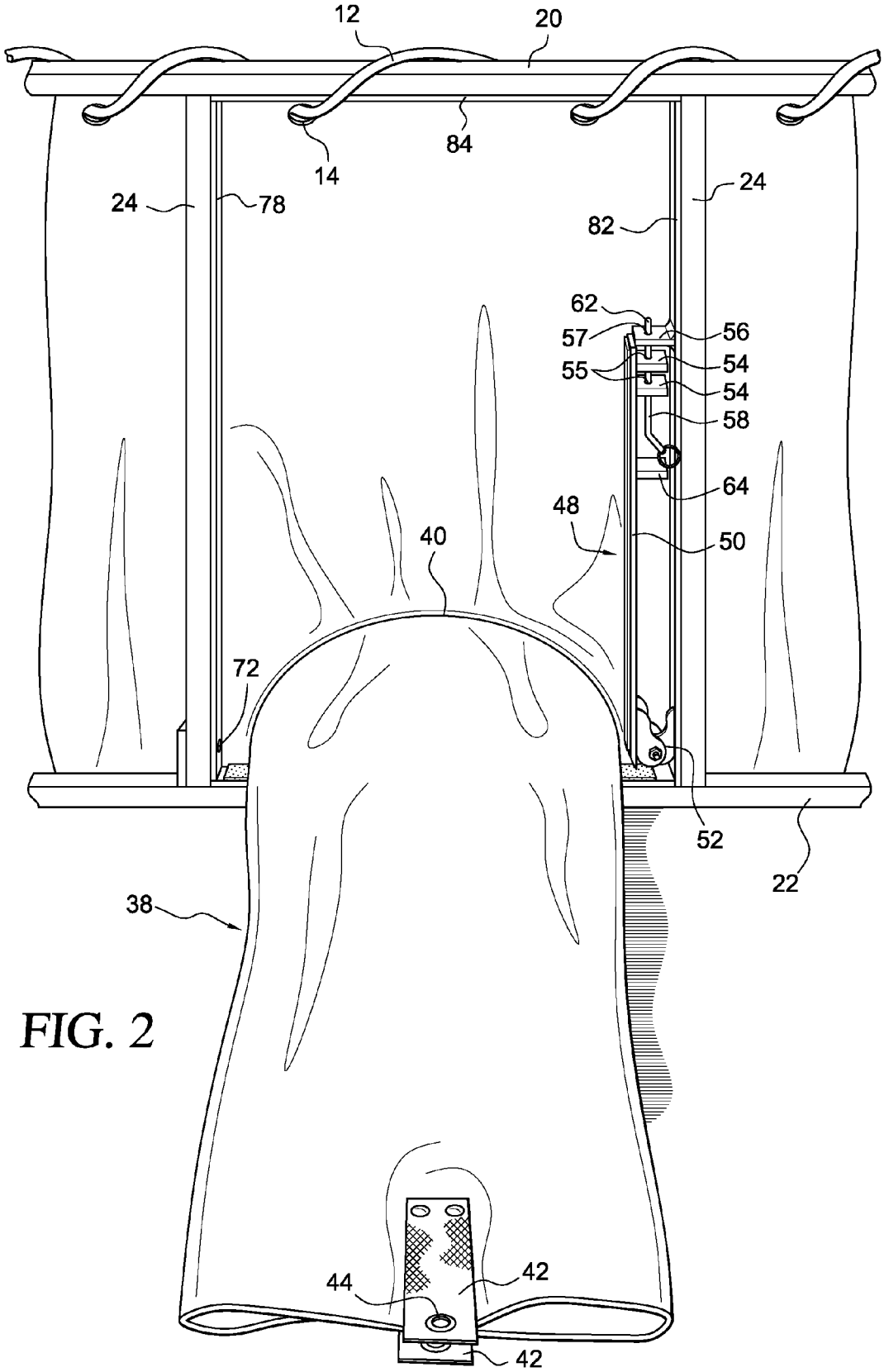
FIG. 2 is an enlarged, fragmentary and perspective view of the portable water tank of FIG. 1, showing an open drain sleeve.

The receptacle 6 has a pair of drain sleeves 38 disposed near the bottom wall 8, as best shown in FIG. 1. Each drain sleeve 38 is made from the same flexible and pliable material as the receptacle 6. Each drain sleeve 38 connects to an opening 40 on the sidewall 10 of the receptacle 6. The drain sleeve 38 extends from the sidewall 10 over a lower rail 22. Referring to FIG. 2, the drain sleeve 38 is framed by a pair of the posts 24 and portions of the upper and lower rails 20 and 22.

Referring to FIG. 2, a pair of straps 42 are secured to the open end of the drain sleeve 38 and are provided with holes 44. The drain sleeve 38 is configured in length so as to be foldable over the upper rail 20 with the straps 42 secured with a tie to a D-shaped ring 46 attached to the sidewall 10, as shown in FIG. 1. This provides stowage for the drain sleeve 38 when not in use.

Figure 3:
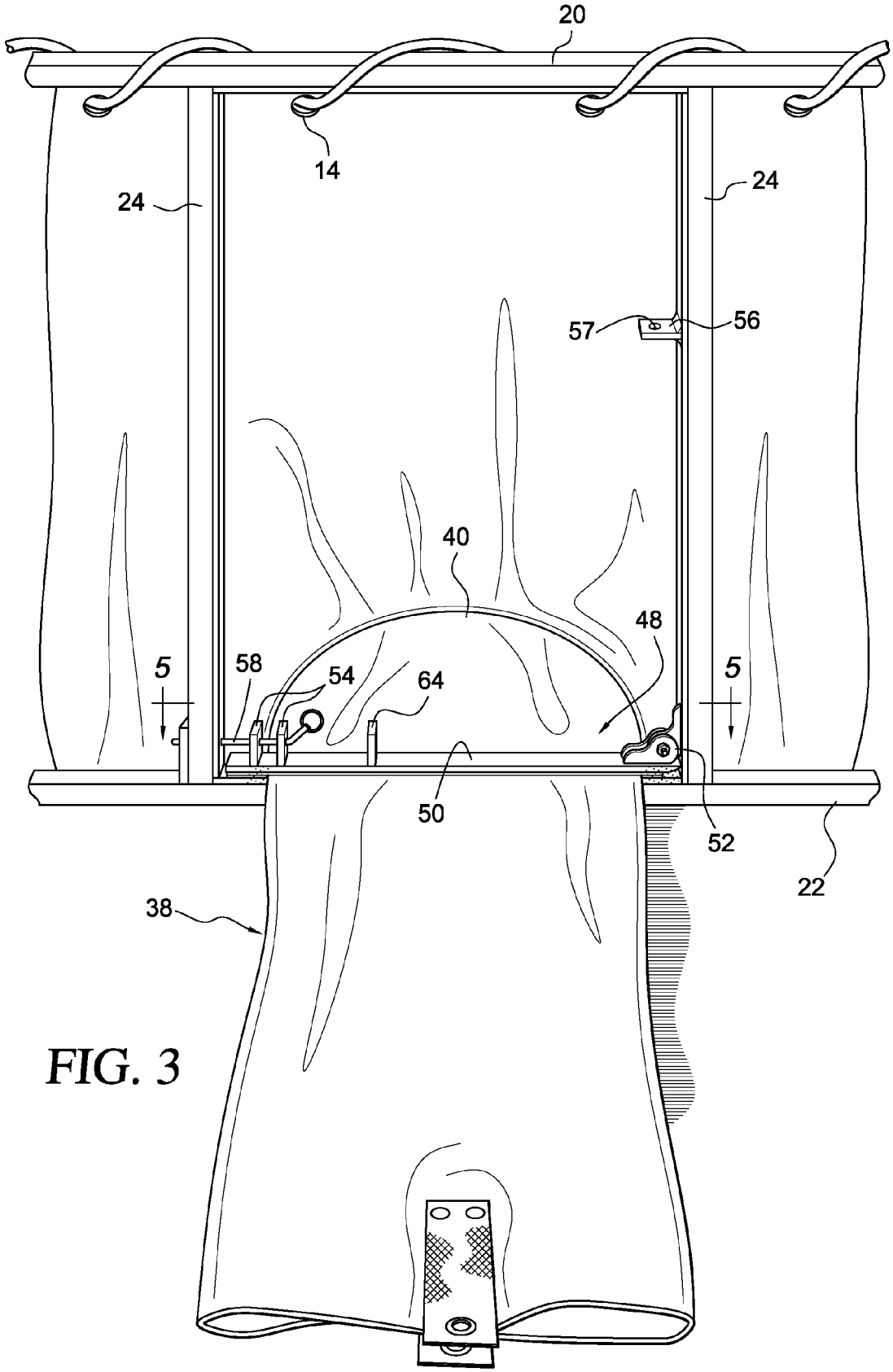
FIG. 3 is an enlarged, fragmentary and perspective view of the portable water tank of FIG. 1, showing a closed drain sleeve.

Referring to FIGS. 2 and 3, the drain sleeve 38 may be opened or closed to water flow with a valve 48 attached to the frame 4. The valve 48 has an open position, as best shown in FIG. 2, and a closed position, as best shown in FIG. 3. The valve 48 includes a rigid, longitudinal, bar-shaped member 50, preferably made of metal or other rigid material, attached with a hinge 52 to one of the vertical posts 24. The member 50 has a vertical position corresponding to the open position, as shown in FIG. 2, and a horizontal position corresponding to the closed position, as shown in FIG. 3.

Figure 4:
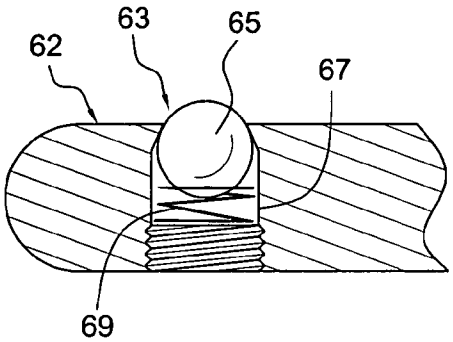
FIG. 4 is an enlarged, fragmentary cross-sectional view of an end portion of a locking pin.

The member 50 is lockable in the vertical or horizontal position. A pair of brackets 54 with aligned holes 55 are attached to the member 50. Another bracket 56 with an opening 57 is attached to the post 24. The aligned holes 55 in the brackets 54 retain a slidable locking pin 58. An end portion 62 of the pin 58 is provided with a ball detent 63, as shown in FIG. 4, that prevents the pin 58 from accidentally sliding out of the hole 57 in the bracket 56, thereby retaining the member 50 in the vertical position, as shown in FIG. 2. The ball detent 63 includes a metal ball 65 captured within a bore and supported therein by a spring 69 that allows the ball to retract into the bore under pressure from the outside and to partly protrude from the bore when the pressure is released. A bracket 64 attached to the member 50 prevents the pin 58 from sliding clear of the holes 55 in the brackets 54.

Figure 6:
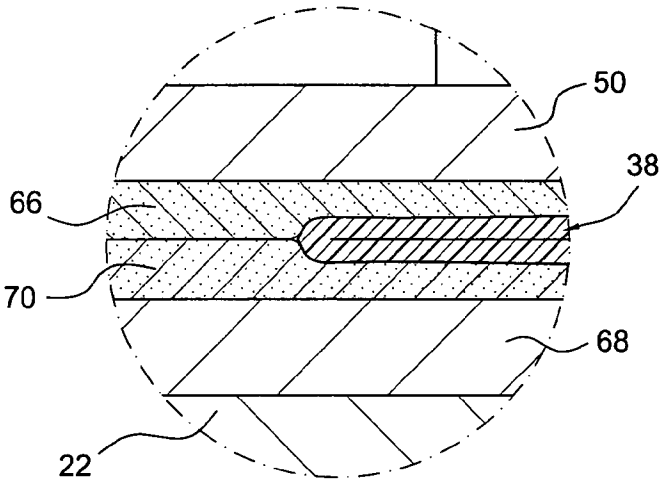
FIG. 6 is an enlarged detail taken from FIG. 5.
Figure 5:
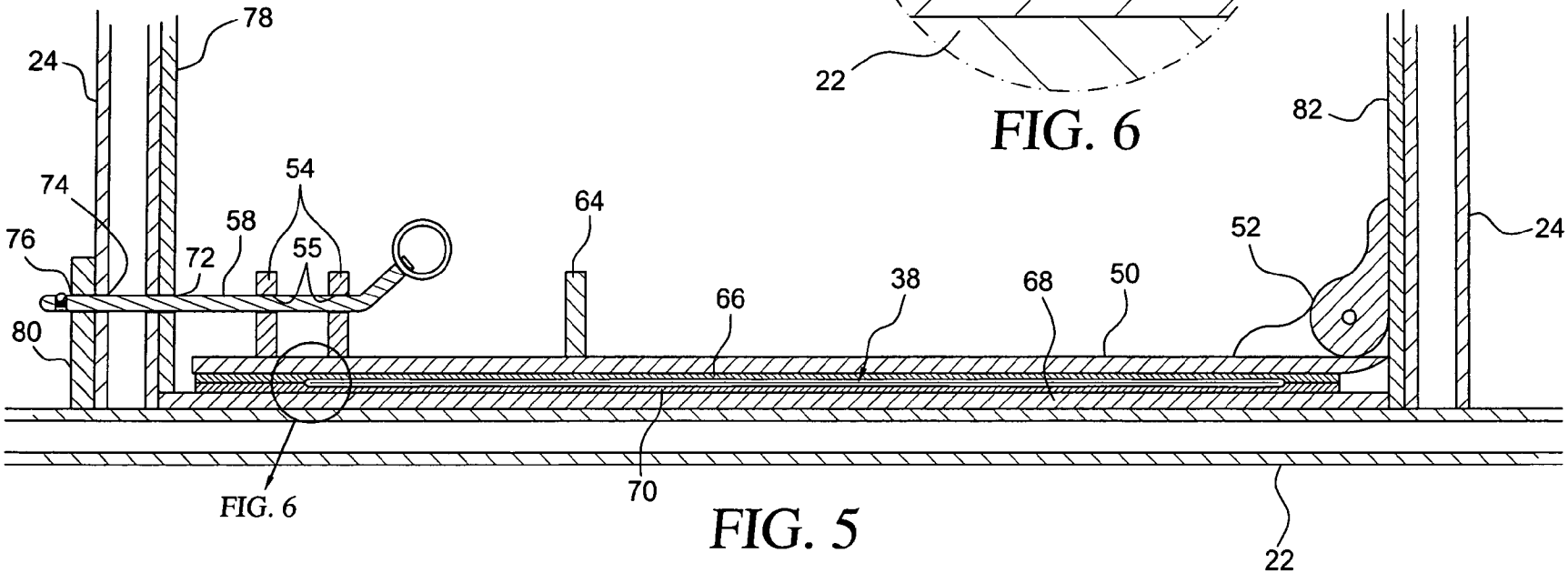
FIG. 5 is a cross-sectional view taken along line 5-5 in FIG. 3, showing a detail of the drain sleeve in the closed position.

Referring to FIGS. 3 and 5, the member 50 in the horizontal position presses the drain sleeve 38 against a reinforcement member 68, preferably bar-shaped and made of metal or rigid material, attached to the lower rail 22, thereby sandwiching the drain sleeve 38 therebetween. The pin 58 holds the member 50 in the horizontal position by being received in aligned holes 72, 74 and 76 in the reinforcement member 78 and the reinforcement bracket 80. The holes 72, 74 and 76 are disposed so as to make the member 50 apply a clamping force on the reinforcement member 68 and the lower rail, thereby to press the drain sleeve 38 shut, as best shown in FIG. 6. The member 50 has on its underside a layer 66 of compressible material, such as rubber. An opposing side of the reinforcement member 68 has a top surface provided with a layer 70 of the same compressible material as the layer 66. The layers 66 and 70 protect the drain sleeve 38 from damage from the members 50 and 68 while being compressed to effectively close the drain sleeve 38. The reinforcement member 68 may be removed, if the lower rail 22 is rigid enough to withstand the clamping action of the member 50, in which case the layer 70 is provided on a top surface of the lower rail 22. Similarly, the reinforcement members 78 and the bracket 80, preferably made of metal or other rigid material, may also not be required, depending on the strength of the post 24, which are made of tubular material. Reinforcement members 82 and 84, preferably bar-shaped and made of metal or other rigid material, are also optional and may be used, if desired, to strengthen the tubular posts 24 and a portion of the upper rail 20 that frame the drain sleeve 38.

The member 50 and the reinforcement members 68, 78, 82 and 84 are substantially the same width as the thickness of the posts 24 and the upper and lower rails 20 and 22 that make up the frame 4 so that they do not protrude beyond the thickness of the upper and the lower rails and the posts, thereby allowing the frame 4 to be folded into a compact, substantially flat configuration for transport and stowage. The space through which the drain sleeve 38 protrudes, defined by a pair of posts 24 and portions of the corresponding upper and lower rails 20 and 22, delineates a volume defined by the thickness of the posts 24 and the upper and lower rails 20 and 22 in which the valve 48 is disposed. By using substantially the same width as the thickness of the frame components, the components of the valve 48 are confined within the volume to provide a compact, non-protruding structure.

By being attached to the frame 4, the valve 48 becomes an integrated part of the tank, improving set up time and eliminating loose equipment that requires a separate inventory or item on a checklist. The valve 48 is also able to use the structure of the frame 4 for some of its operating parts.

The drain sleeve 38 is used for draining the receptacle 6 of any remaining water after use. The drain sleeve 38 may also be used to connect to another drain sleeve provided in another tank so as to provide greater capacity over a single tank.

While this invention has been described as having preferred design, it is understood that it is capable of further modification, uses and/or adaptations following in general the principle of the invention and including such departures from the present disclosure as come within known or customary practice in the art to which the invention pertains, and as may be applied to the essential features set forth, and fall within the scope of the invention or the limits of the appended claims.

I claim:

1. A portable water tank, comprising:

a) a foldable receptacle having a bottom wall and vertical sidewalls;

b) a frame to support said sidewalls in an upright position, said frame including upper and lower rails, and vertical posts joining said upper rail to said lower rail;

c) said receptacle including a pliable drain sleeve disposed near said bottom wall, said sleeve extending between a pair of said posts and corresponding portion of said lower rail disposed between said pair of said posts, said sleeve overlying said corresponding portion of said lower rail;

d) a valve attached to said frame, said valve is operably associated with said drain sleeve, said valve having an open position to allow water within said receptacle to flow through said drain sleeve, and a closed position to keep water from flowing through said drain sleeve;

e) said valve including a movable member;

f) a hinge attached both to one end of said movable member and to said frame;

g) reinforcement members attached to said corresponding portion of said lower rail and said pair of posts;

h) said movable member including a horizontal position wherein said drain sleeve is sandwiched between said reinforcement member on said corresponding portion of said lower rail and said movable member, thereby to close said drain sleeve to water flow; and i) a lock to retain said movable member in said horizontal position.

2. A portable water tank as in claim 1, wherein:

a) said movable member and said reinforcement member on said corresponding portion of said lower rail have opposing surfaces; and b) said opposing surfaces each includes a layer of compressible material.

3. A portable water tank as in claim 2, wherein said material is rubber.

4. A portable water tank as in claim 1, wherein said hinge is secured to one of said pair of said posts.

5. A portable water tank as in claim 1, wherein:

a) said movable member has substantially the same thickness as said pair of posts and said corresponding portion of said lower rail; and b) said reinforcement members have substantially the same thickness as said pair of said posts and said corresponding portion of said lower rail.

6. A portable water tank as in claim 1, wherein:

a) said lock includes a slidable pin attached to said movable member; and b) said one of said pair of posts includes an opening adapted to receive said pin to secure said movable member in said horizontal position.

7. A portable water tank as in claim 1, wherein:

a) said movable member includes a vertical position wherein said drain sleeve is open to water flow.

8. A portable water tank as in claim 7, wherein:

a) said lock includes a slidable pin attached to said movable member; and b) said one of said pair of posts includes a bracket having an opening adapted to receive said pin to keep said movable member in said vertical position.

9. A portable water tank as in claim 1, wherein a corresponding portion of said upper rail disposed between said pair of posts includes a reinforcement member.

10. A portable water tank as in claim 1, wherein said movable member is bar-shaped.

11. A portable water tank as in claim 1, wherein said drain sleeve includes an end portion configured in length to be draped over said upper rail and attachable to said sidewall.

12. A portable water tank as in claim 11, and further comprising:

a) a strap attached to said end portion; and b) said strap is attachable to said sidewall.

13. A portable water tank as in claim 12, wherein:

a) said sidewall includes a ring; and b) said strap is attachable to said ring.

14. A portable water tank as in claim 6, wherein an end portion of said pin includes a ball detent.

15. A portable water tank as in claim 1, wherein said frame is foldable.

16. A portable water tank as in claim 15, wherein:

a) said upper and lower rails and said posts have substantially the same thickness; and b) said valve has substantially the same thickness as said upper and lower rails and said posts, said valve is disposed within a space defined by said thickness.

17. A portable water tank, comprising:

a) a foldable receptacle having a bottom wall and vertical sidewalls;

b) a foldable frame to support said sidewalls in an upright position;

c) said frame having upper and lower rails, and vertical posts joining said upper rails to said lower rails;

d) said receptacle including a pliable drain sleeve disposed near said bottom wall, said sleeve extending between a pair of said posts and between corresponding portions of said upper and lower rails disposed between said pair of said posts; and e) a longitudinal member hinged at one end to said frame and lockable at another end, said member having a clamping position wherein said member presses said sleeve operably against a corresponding portion of said frame to flatten said sleeve and thereby close its opening to water flow, said member having an open position to allow water flow through said sleeve.

18. A portable water tank as in claim 17, wherein said corresponding portion of said frame includes said corresponding portion of said lower rail.

19. A portable water tank as in claim 18, wherein said corresponding portion of said lower rail includes a reinforcement member.

20. A portable water tank as in claim 19, wherein:

a) said member and said reinforcement member have opposing surfaces; and b) said opposing surfaces each includes a layer of compressible material.

21. A portable water tank as in claim 20, wherein said material is rubber.

22. A portable water tank as in claim 17, wherein:

a) said frame includes a first pair of opposite sides; and b) said first pair of opposite sides are foldable in half.

23. A portable water tank as in claim 22, wherein:

a) said frame includes a second pair of opposite sides; and b) said drain sleeve is associated with one of said second pair of opposite sides.

24. A portable water tank as in claim 23, and further comprising another drain sleeve associated with another of said second pair of opposite sides.

25. A portable water tank as in claim 17, wherein said member is hinged to one of said pair of said posts.

* * * * *